US008162358B2

(12) United States Patent
Lin

(10) Patent No.: US 8,162,358 B2
(45) Date of Patent: Apr. 24, 2012

(54) LOCK DEVICE

(75) Inventor: Ching Tien Lin, Taipei Hsien (TW)

(73) Assignee: Thase Enterprise Co., Ltd., Taipei Hsien (TW)

( * ) Notice: Subject to any disclaimer, the term of this patent is extended or adjusted under 35 U.S.C. 154(b) by 514 days.

(21) Appl. No.: 12/460,026

(22) Filed: Jul. 10, 2009

(65) Prior Publication Data

US 2011/0006549 A1 Jan. 13, 2011

(51) Int. Cl.
*E05C 1/12* (2006.01)

(52) U.S. Cl. ..... 292/167; 292/34; 292/36; 70/107; 70/149

(58) Field of Classification Search ..... 292/167, 292/169.14–17, 336.3, 33–37; 70/107, 149, 70/188, 189, 218, 222, 223, 277, 278.7, 283, 70/422, 475
See application file for complete search history.

(56) References Cited

U.S. PATENT DOCUMENTS

| | | | | |
|---|---|---|---|---|
| 4,820,330 | A | 4/1989 | Lin | 70/277 |
| 5,010,752 | A | 4/1991 | Lin | 70/277 |
| 5,074,607 | A | 12/1991 | Lin | 292/359 |
| 6,354,121 | B1 * | 3/2002 | Frolov | 70/277 |
| 6,619,705 | B2 * | 9/2003 | Dalsing | 292/169.14 |
| 6,622,535 | B2 * | 9/2003 | Chiang et al. | 70/107 |
| 7,181,940 | B2 * | 2/2007 | Lin | 70/472 |
| 7,634,927 | B1 * | 12/2009 | Tien | 70/92 |
| 7,698,918 | B2 * | 4/2010 | Geringer et al. | 70/278.7 |
| 8,011,702 | B2 * | 9/2011 | Tien et al. | 292/336.3 |
| 8,079,238 | B2 * | 12/2011 | Lin | 70/107 |
| 2007/0114801 | A1 * | 5/2007 | Lin | 292/336.3 |
| 2010/0263418 | A1 * | 10/2010 | Moon | 70/107 |
| 2011/0006549 | A1 * | 1/2011 | Lin | 292/167 |

* cited by examiner

*Primary Examiner* — Kristina Fulton
(74) *Attorney, Agent, or Firm* — Charles E. Baxley

(57) ABSTRACT

A lock device includes a casing formed in a housing for rotatably receiving a rotary member which has an actuating finger and which is coupled to a handle with a driving shank, and a spring biasing device attached to the housing and engaged with the actuating finger of the rotary member for biasing the handle back to an original position and for biasing the actuating finger of the rotary member back to an original position when the handle is released, the spring biasing device is locked to the housing with a fastener to disengage the follower from the actuating finger of the rotary member when a spring biasing member is engaged between the handle and the housing to bias the handle back to an original position.

4 Claims, 8 Drawing Sheets

LOCK DEVICE

BACKGROUND OF THE INVENTION

1. Field of the Invention

The present invention relates to a lock device, and more particularly to a lock device including an improved structure for preventing the lock device from being destroyed or damaged by the unauthorized persons and for allowing the lock device to be used or operated even when the lock device has been destroyed or damaged by the unauthorized persons.

2. Description of the Prior Art

Typical lock devices are normally attached to a door panel, and comprise a dead bolt extendible out of the lock casing for engaging with a door frame and for selectively locking the door panel to the door frame.

For example, U.S. Pat. No. 4,820,330 to Lin, U.S. Pat. No. 5,010,752 to Lin, and U.S. Pat. No. 5,074,607 to Lin disclose three of the typical lock devices each also comprising a lock casing secured to a door panel, and a dead bolt extendible out of the lock casing for engaging with a door frame, and a handle attached or coupled to the dead bolt of the lock device for rotating or operating the handle.

Normally, a spring biasing member is attached to the handle or coupled between the handle and the lock casing for biasing or recovering the handle back to the original position and also for biasing or recovering the dead bolt to engage with the door frame after the handle is released by the user.

However, when the spring biasing member is destroyed or damaged by the unauthorized persons, the dead bolt may no longer be biased or forced by the spring biasing member to engage with the door frame after the handle is released by the user, and the door panel may no longer be locked or anchored to the door frame with the dead bolt.

The present invention has arisen to mitigate and/or obviate the afore-described disadvantages of the conventional lock devices for door panels.

SUMMARY OF THE INVENTION

The primary objective of the present invention is to provide a lock device including an improved structure for preventing the lock device from being destroyed or damaged by the unauthorized persons and for allowing the lock device to be used or operated even when the lock device has been destroyed or damaged by the unauthorized persons.

In accordance with one aspect of the invention, there is provided a lock device comprising a housing including a chamber formed therein, and including a casing provided in the chamber of the housing, and including a compartment formed in the casing, a rotary member rotatably received in the compartment of the casing, and including an actuating finger extended outwardly therefrom, and including an engaging hole formed therein, a driving shank engaged with the engaging hole of the rotary member for rotating the rotary member relative to the casing and the housing, a handle attached to the driving shank for actuating and operating the driving shank to rotate the actuating finger of the rotary member relative to the casing and the housing, and a spring biasing device attached to the housing and engaged with the actuating finger of the rotary member for biasing the handle back to an original position and for biasing the actuating finger of the rotary member back to an original position when the handle is released.

The casing includes a channel formed in the casing and communicative with the compartment of the casing for slidably receiving the actuating finger of the rotary member and for limiting the rotary member to rotate relative to the casing and the housing.

The casing includes a cover attached onto the casing for engaging with the rotary member and for anchoring the rotary member in the compartment of the casing, and includes an orifice formed in the cover for partially receiving the rotary member and for allowing the engaging hole of the rotary member to be exposed and to be engaged with the driving shank.

The spring biasing device includes a follower rotatably attached to the housing with a pivot axle and having a first end for engaging with the actuating finger of the rotary member and for allowing the follower to be rotated relative to the housing with the actuating finger of the rotary member, and having a second end extended outwardly therefrom, a sliding member slidably attached to the housing, and having an opening formed therein for engaging with the second end of the follower and for allowing the sliding member to be moved relative to the housing by the follower, and a first spring biasing member engaged with the sliding member for biasing the sliding member to rotate the follower relative to lock housing, and to rotate the handle and the rotary member relative to the casing and the housing.

The handle includes a second spring biasing member engaged therein and attached between the handle and the housing for biasing the handle back to an original position and for biasing the actuating finger of the rotary member back to an original position when the handle is released The housing includes a fastener securing the follower to the housing and to is engage the first end of the follower from the actuating finger.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
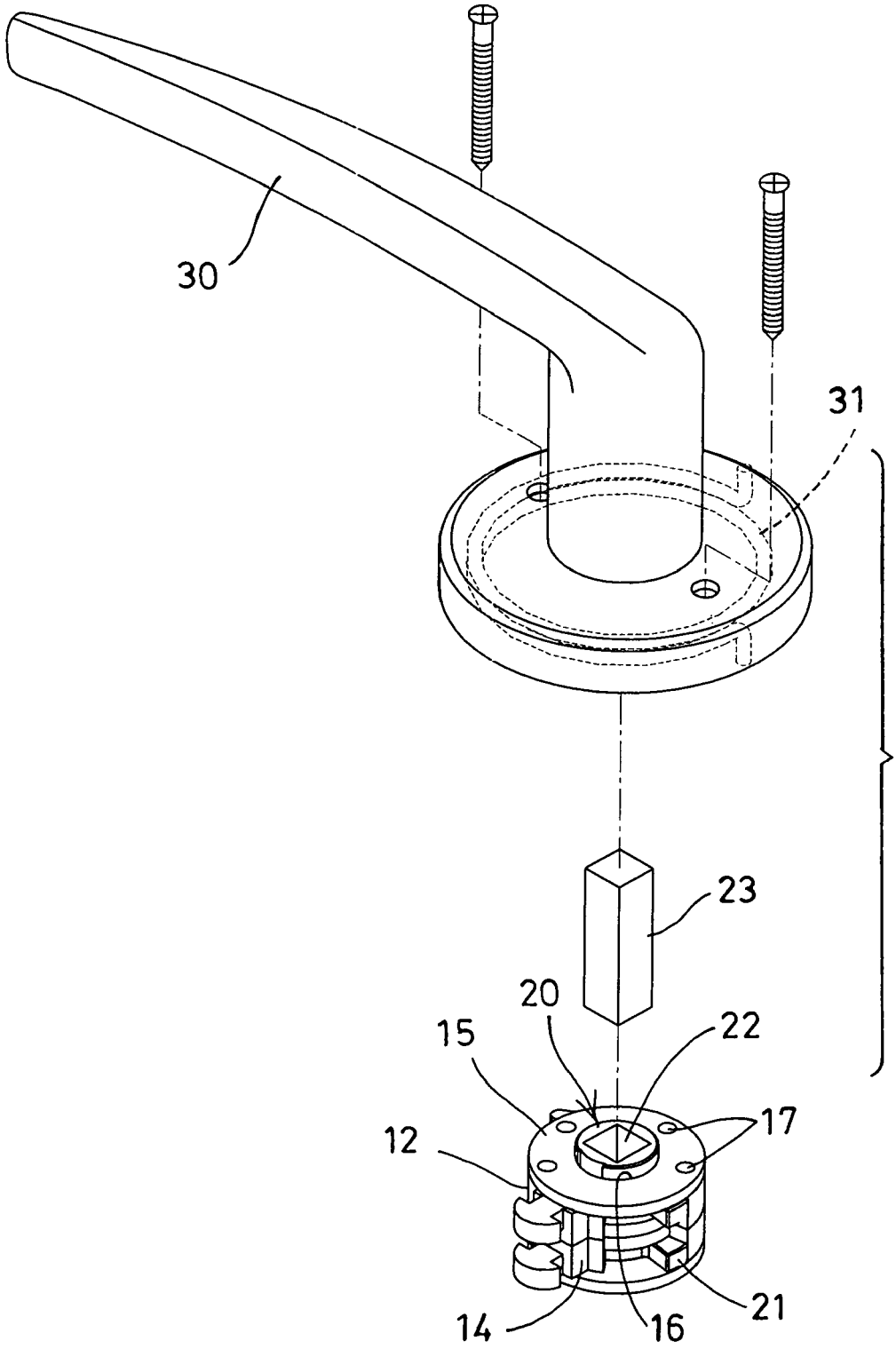
FIG. 1 is a partial exploded view of a lock device in accordance with the present invention.
Figure 2:
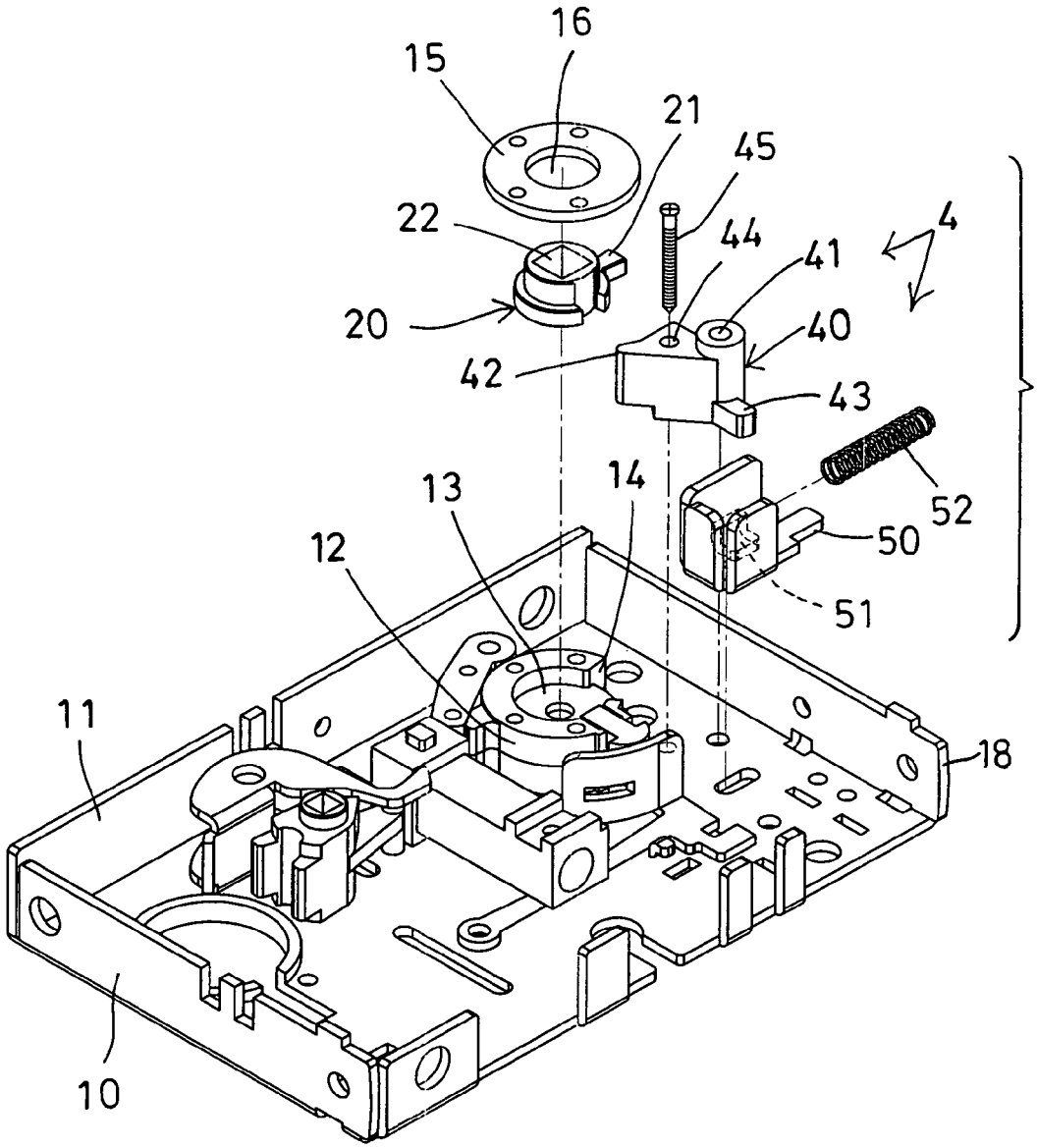
FIG. 2 is another partial exploded view of the lock device.
Figure 3:
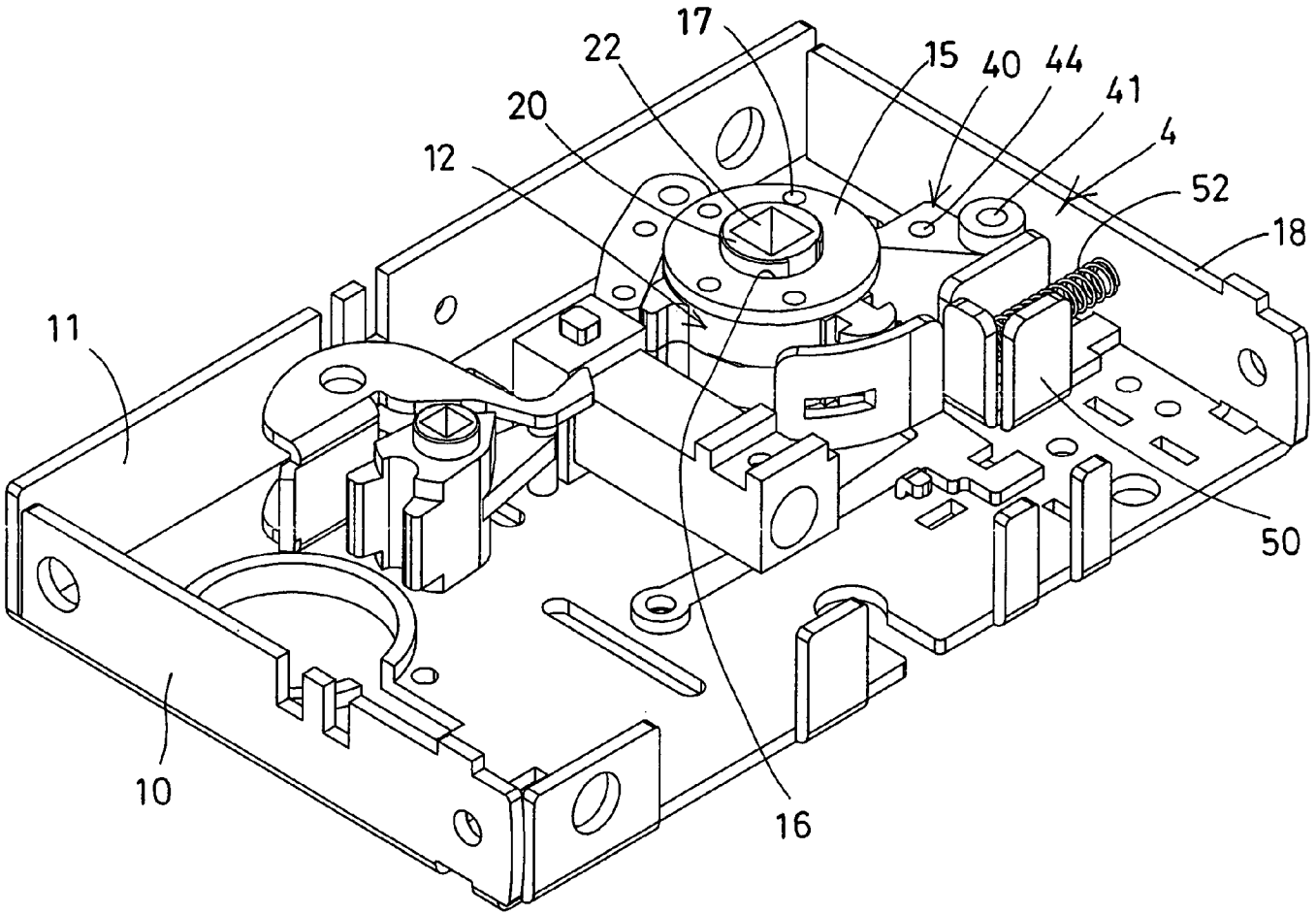
FIG. 3 is a partial perspective view of the lock device.

Referring to the drawings, and initially to FIGS. 1-4, a lock device in accordance with the present invention comprises a lock housing 10 including a chamber 11 formed therein, and including a hub or casing 12 formed or extended or provided in the chamber 11 of the lock housing 10, and including a compartment 13 formed in the casing 12, and including a notch or channel 14 formed in the casing 12 and communicative with the compartment 13 of the casing 12, in which the casing 12 may be solidly formed or molded in the lock housing 10, or may be formed separately (FIGS. 1, 6) and then secured to the lock housing 10 with adhesive materials, latches or locks or fasteners (not shown), or by welding processes.

A rotary member 20 is pivotally or rotatably received in the compartment 13 of the casing 12, and includes an extension or actuating finger 21 extended outwardly therefrom, and includes an engaging hole 22 formed therein, particularly a non-circular or square engaging hole 22 formed therein for engaging with a corresponding non-circular driving shank 23 which includes a square cross section, and for allowing the rotary member 20 to be pivoted or rotated relative to the casing 12 and the lock housing 10 by the driving shank 23. The extension or actuating finger 21 of the rotary member 20 is slidably received or engaged in the channel 14 of the casing 12 and limited to pivot or rotate relative to the casing 12 and the lock housing 10 by the channel 14 of the casing 12.

A cover 15 is attached or secured to the upper portion of the casing 12 with latches or locks or fasteners 17 for engaging with the rotary member 20 and for stably anchoring or retaining the rotary member 20 in the compartment 13 of the casing 12, and includes an orifice 16 formed therein for partially receiving the rotary member 20 and for allowing the engaging hole 22 of the rotary member 20 to be exposed and to be engaged with the driving shank 23. A handle 30 is attached or coupled to the driving shank 23 for actuating or operating the driving shank 23 to pivot or rotate the actuating finger 21 of the rotary member 20 relative to the casing 12 and the lock housing 10, in order to actuate or operate a locking member or dead bolt (not shown) to lock a door panel to a door frame (not shown).

Figure 5:
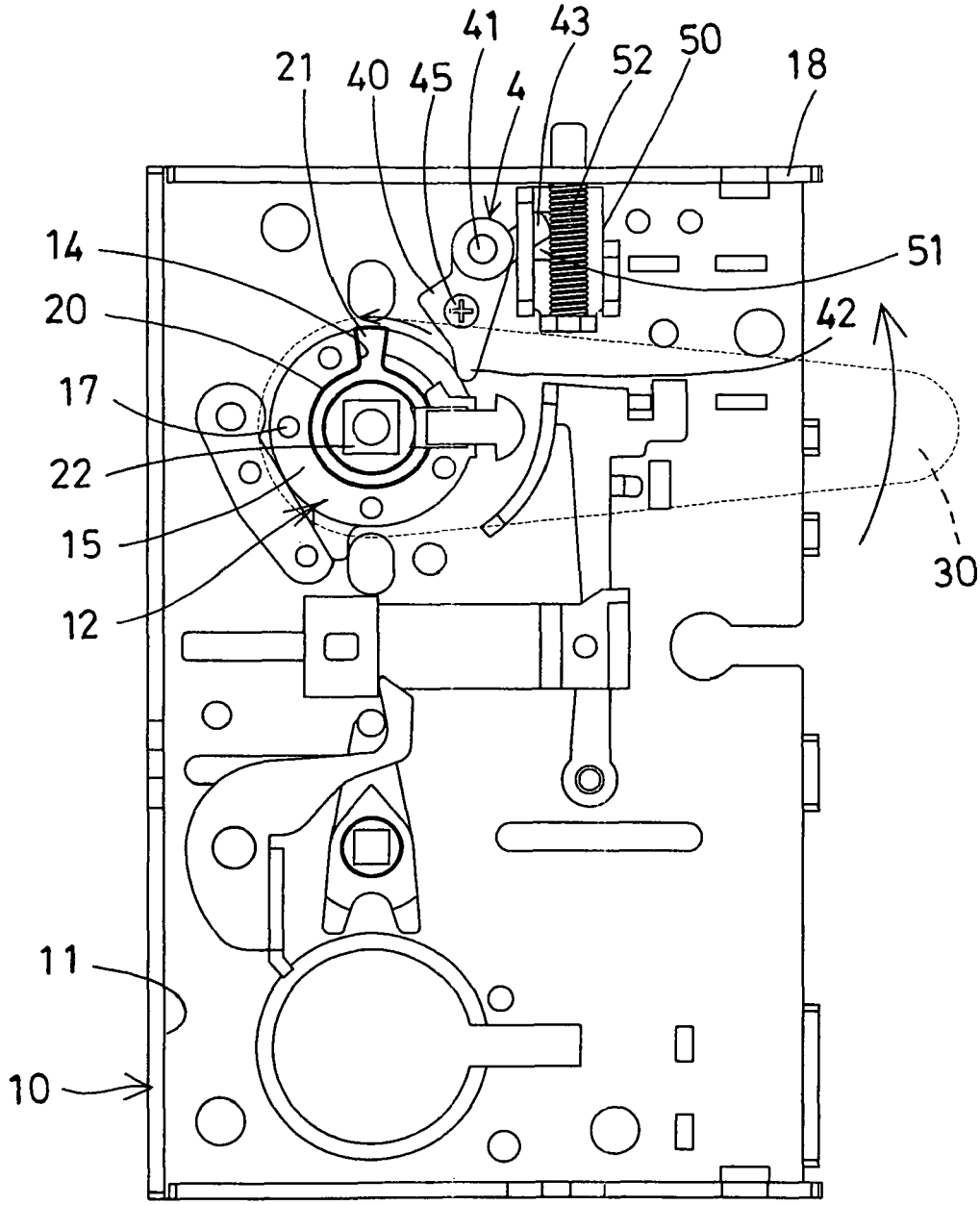
FIG. 5 is a top plan schematic view similar to FIG. 4, illustrating the operation of the lock device.

A spring biasing member 31 may be attached or coupled between the handle 30 and the casing 12 or the lock housing 10 for biasing or recovering the handle 30 back to the original position as shown in dotted lines in FIG. 5, and also for biasing or recovering the actuating finger 21 of the rotary member 20 back to the original position as shown in FIG. 5 when or after the handle is released by the user. The above-described structure including the lock housing 10 and the coupling or engagement of the handle 30 to the rotary member 20 is typical and will not be described in further details, the locking member or dead bolt and the door panel and the door frame are also typical and will not be described in further details.

A follower 40 is pivotally or rotatably received in the chamber 11 of the lock housing 10 and disposed beside and outside the casing 12, and pivotally or rotatably attached or secured to the lock housing 10 with a pivot axle 41 for allowing the follower 40 to be pivoted or rotated relative to the casing 12 and the lock housing 10 with the pivot axle 41, and includes one end or first end 42 for engaging with the actuating finger 21 of the rotary member 20 and for allowing the follower 40 to be pivoted or rotated relative to the lock housing 10 with or by the actuating finger 21 of the rotary member 20, and includes the other end or second end 43 extended outwardly therefrom and arranged to have the pivot axle 41 located between the two ends 42, 43 of the follower 40. The follower 40 may further include an aperture 44 formed therein for engaging with a screw or fastener 45.

A sliding member 50 is slidably attached or secured to the lock housing 10 and limited to slide relative to the lock housing 10, and includes an opening 51 formed therein for receiving or engaging with the other end or second end 43 of the follower 40, and for allowing the sliding member 50 to be moved or slid relative to the lock housing 10 by the rotation of the follower 40 relative to the lock housing 10. Another spring biasing member 52 may be attached or coupled between the lock housing 10 and the sliding member 50 for biasing or forcing the sliding member 50 to move or slide away from a side wall or wall member 18 of the lock housing 10, and for actuating or operating the sliding member 50 to rotate the follower 40 relative to the lock housing 10, and then for actuating or operating the follower 40 to engage with the actuating finger 21 of the rotary member 20 and to rotate the rotary member 20 relative to the casing 12 and the lock housing 10, and thus for rotating or for recovering the handle 30 back to the original position as shown in dotted lines in FIG. 8.

Figure 6:
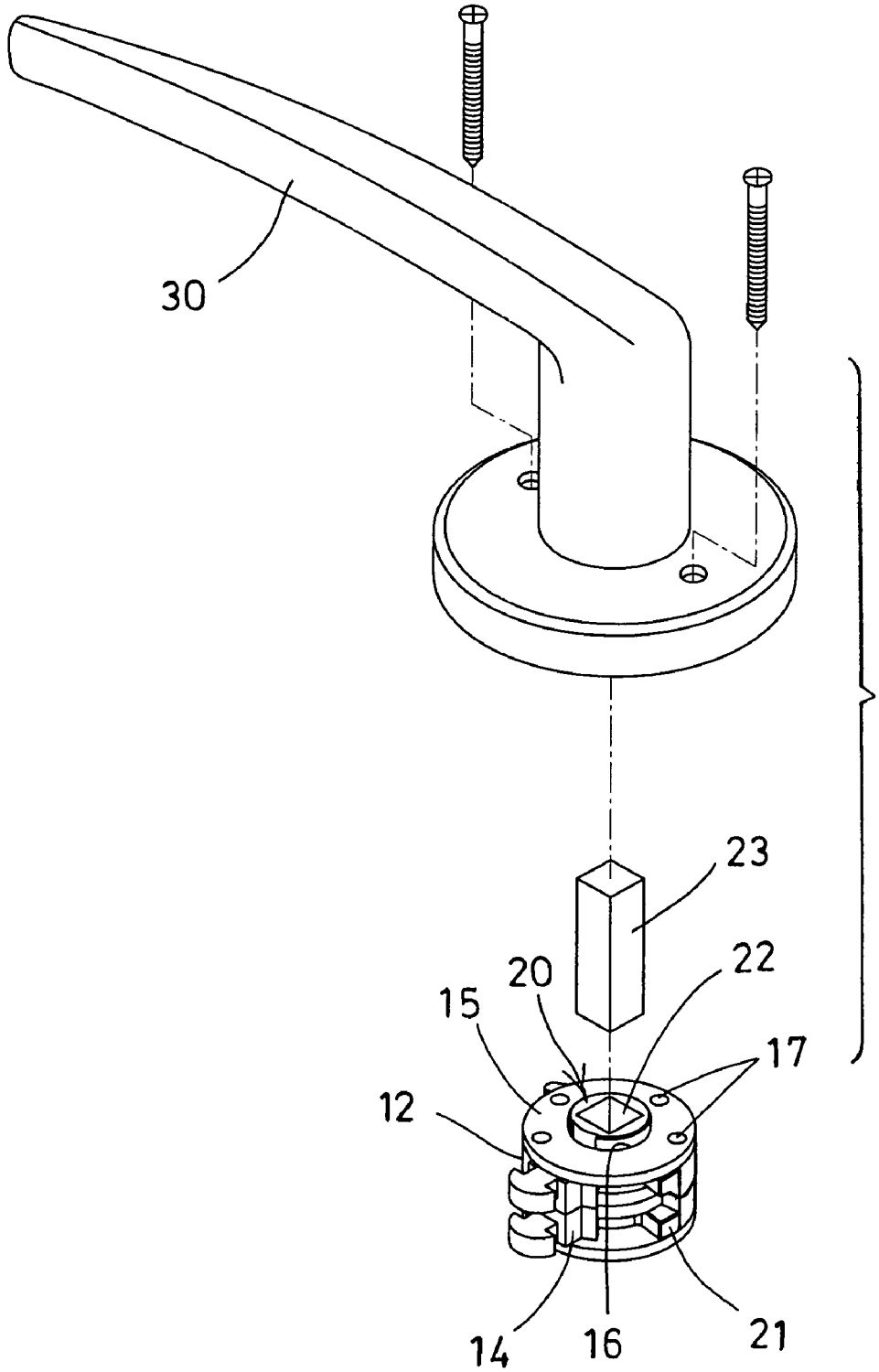
FIG. 6 is a further partial exploded view similar to FIG. 1 illustrating the other arrangement of the lock device.
Figure 7:
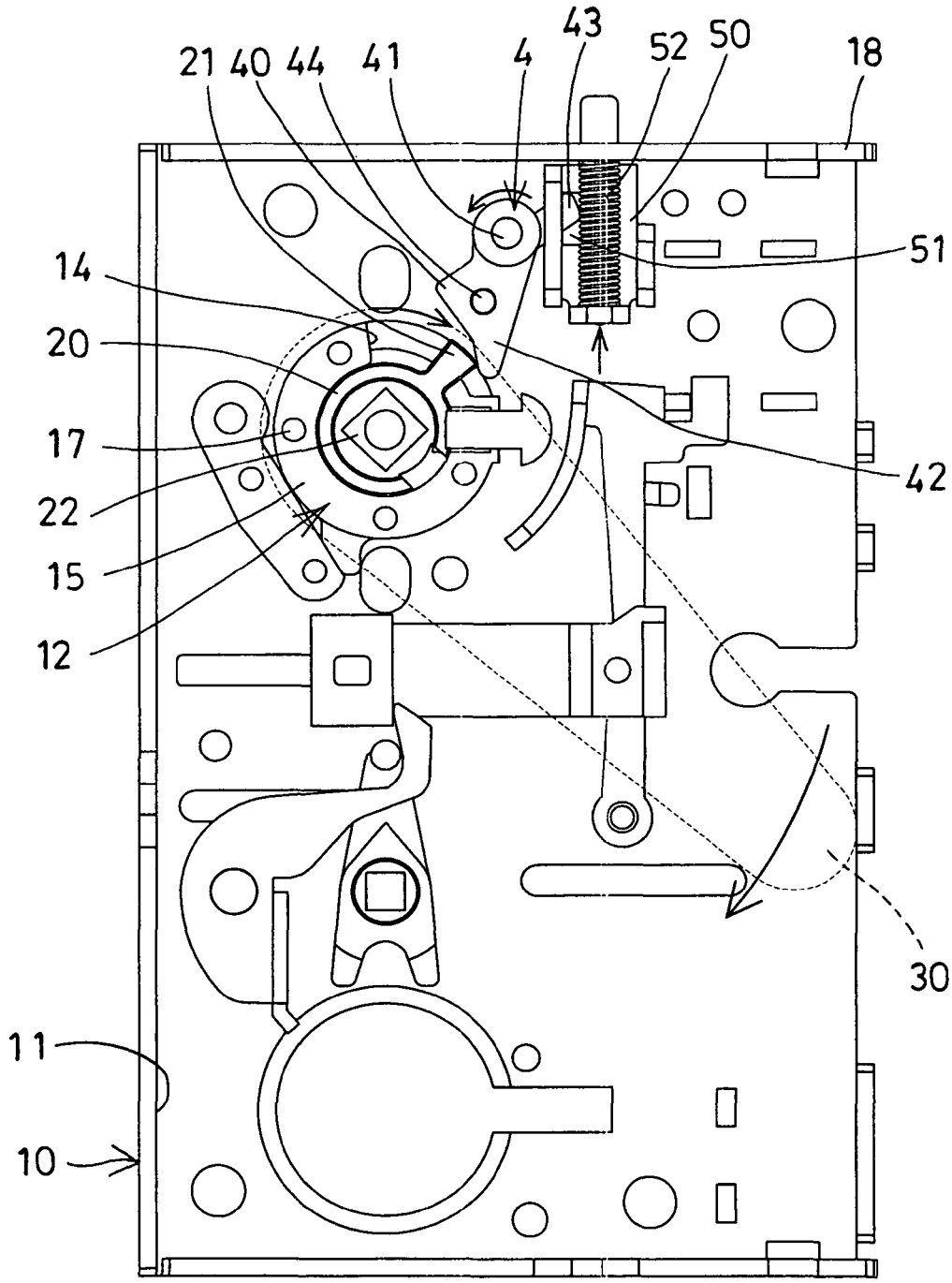
FIG. 7 is a top plan schematic view of the lock device as shown in FIG. 6.
Figure 8:
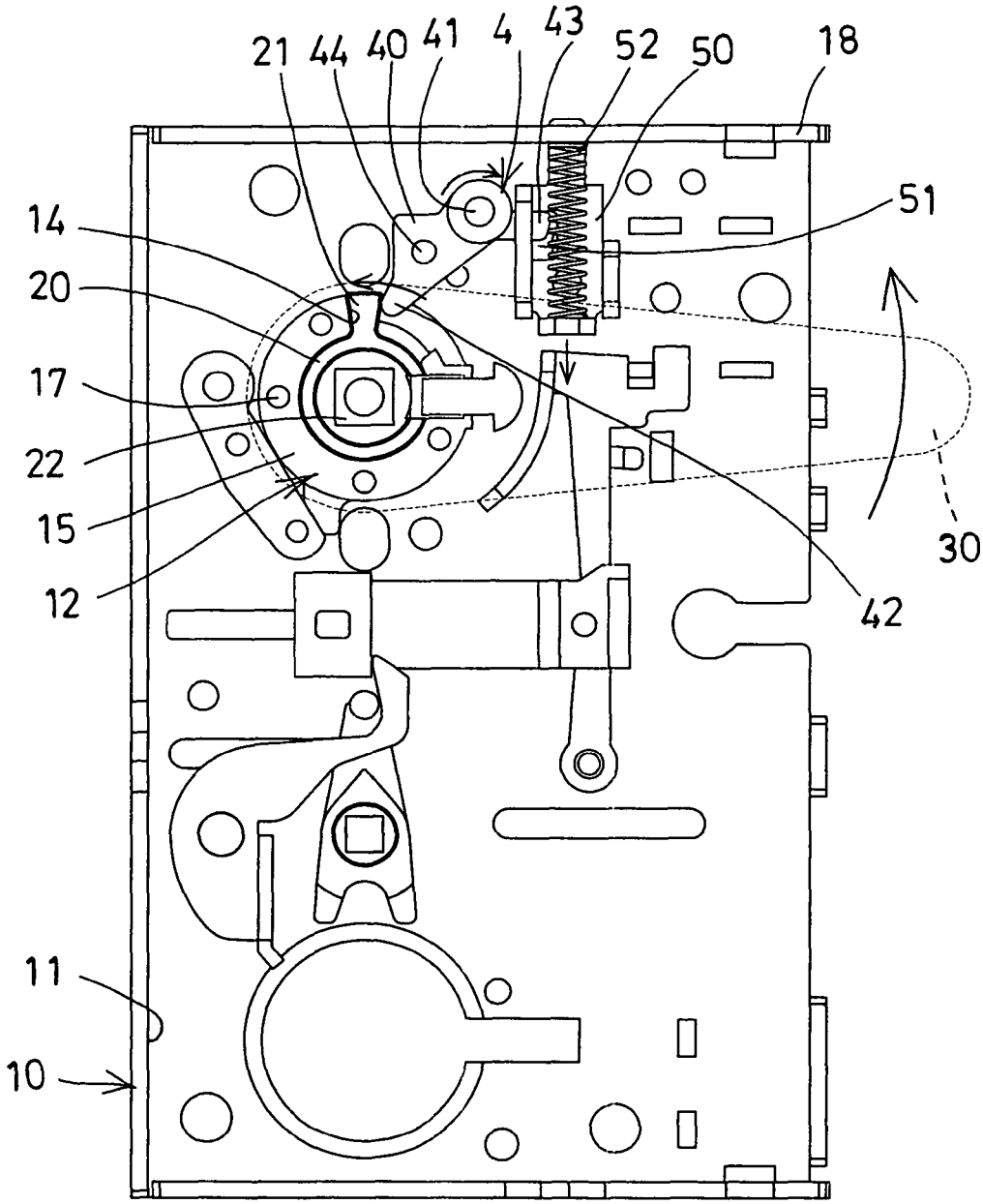
FIG. 8 is a top plan schematic view similar to FIG. 7, illustrating the operation of the lock device as shown in FIGS. 6-7.

In operation, as shown in FIGS. 6-8, when the handle 30 has no spring biasing member 31 engaged therein, and when the handle 30 is released by the user, the spring biasing member 52 may bias or force the sliding member 50 to move or slide away from the side wall 18 of the lock housing 10, and to actuate or operate the sliding member 50 to rotate the follower 40 relative to the lock housing 10, and then to actuate or operate the follower 40 to engage with the actuating finger 21 of the rotary member 20 and to rotate the rotary member 20 relative to the casing 12 and the lock housing 10, and thus to rotate or to recover the handle 30 back to the original position such that the handle 30 may be biased back to the original position with the spring biasing member 52 without the spring biasing member 31.

Figure 4:
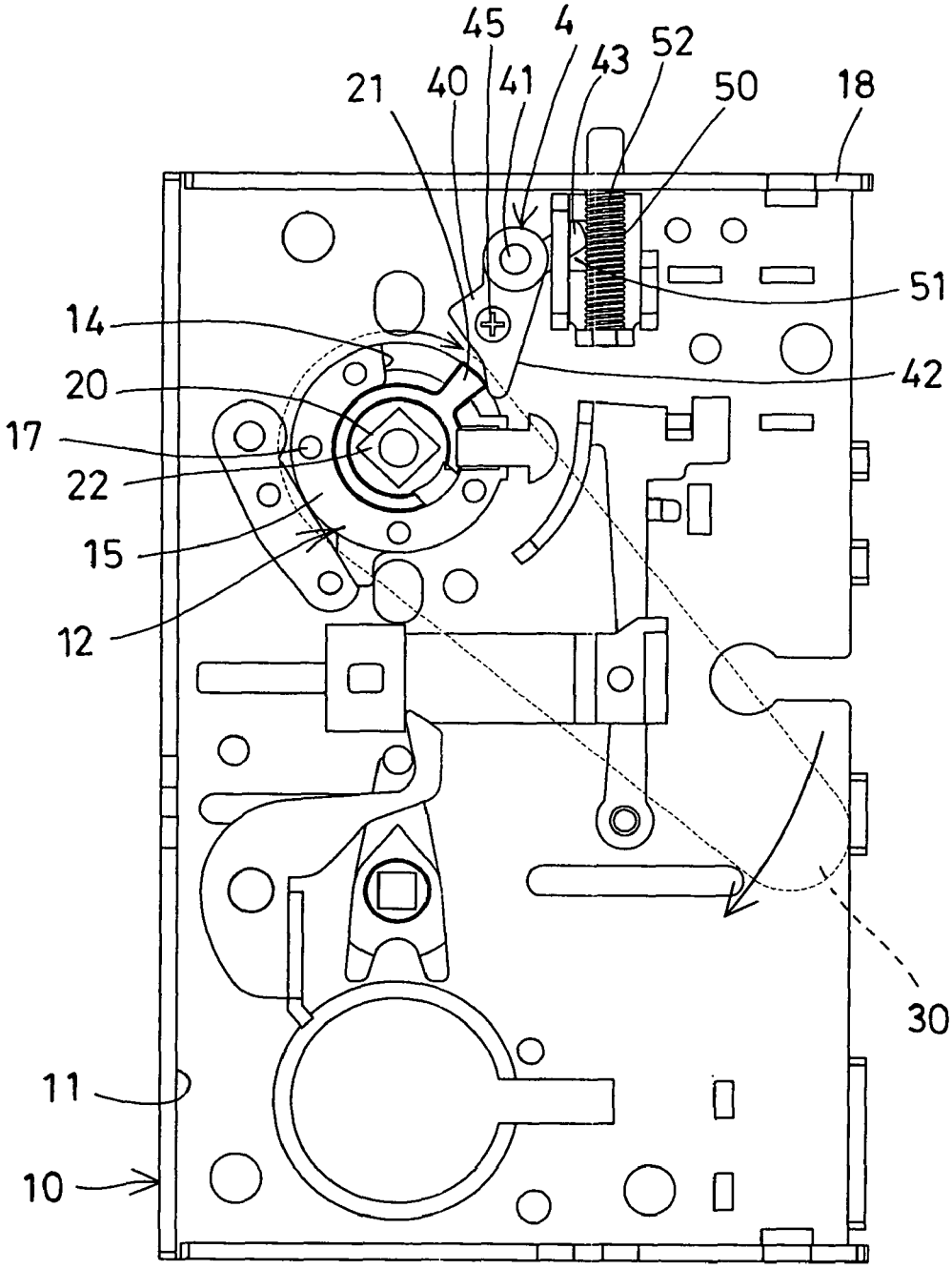
FIG. 4 is a top plan schematic view of the lock device.

As shown in FIGS. 1 and 4-5, when a spring biasing member 31 is engaged into the handle 30, the rotary member 20 and the handle 30 may be biased back to the original position with the spring biasing member 31 without the spring biasing member 52. At this moment, the fastener 45 may be engaged through the aperture 44 of the follower 40 and may be engaged with the lock housing 10, and the sliding member 50 may be maintained in the position toward or engaged with the side wall 18 of the lock housing 10 and may compress the spring biasing member 52, and thus may disengage the first end 42 of the follower 40 from the actuating finger 21 of the rotary member 20, in order to prevent the rotary member 20 and the handle 30 from being rotated relative to the casing 12 and the lock housing 10 by the follower 40.

It is to be noted that the spring biasing member 52 may bias or force the sliding member 50 to actuate the follower 40 to rotate the rotary member 20 and the handle 30 relative to the casing 12 and the lock housing 10 and may rotate or recover the handle 30 back to the original position when the handle 30 has no spring biasing member 31 engaged therein. Alternatively, when a spring biasing member 31 is engaged into the handle 30, the rotary member 20 and the handle 30 may be biased back to the original position with the spring biasing member 31 without the spring biasing member 52, and the fastener 45 may secure the follower 40 to the lock housing 10 and may disengage the first end 42 of the follower 40 from the actuating finger 21 of the rotary member 20, and may prevent the rotary member 20 and the handle 30 from being rotated relative to the casing 12 and the lock housing 10 by the follower 40, such that the lock device in accordance with the present invention may be used for the handle 30 with or without the spring biasing member 31. The follower 40 and the sliding member 50 the spring biasing member 52 may thus be formed or acted as a spring biasing device 4 to bias or force the rotary member 20 and the handle 30 back to the original position when the handle 30 has no spring biasing member 31 engaged therein.

Accordingly, the lock device in accordance with the present invention includes an improved structure for preventing the lock device from being destroyed or damaged by the unauthorized persons and for allowing the lock device to be used or operated even when the lock device has been destroyed or damaged by the unauthorized persons.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A lock device comprising:

a housing including a chamber formed therein, and including a casing provided in said chamber of said housing, and including a compartment formed in said casing, said casing including a channel formed in said casing and communicative with said compartment of said casing, a rotary member rotatably received in said compartment of said casing, and including an actuating finger extended outwardly therefrom and slidably received in said channel of said casing for limiting said rotary member to rotate relative to said casing and said housing, and including an engaging hole formed in said rotary member, a driving shank engaged with said engaging hole of said rotary member for rotating said rotary member relative to said casing and said housing, a handle attached to said driving shank for actuating and operating said driving shank to rotate said actuating finger of said rotary member relative to said casing and said housing, a follower rotatably attached to said housing with a pivot axle and including a first end for engaging with said actuating finger of said rotary member and for allowing said follower to be rotated relative to said housing with said actuating finger of said rotary member, and having a second end extended outwardly therefrom, a sliding member slidably attached to said housing, and including an opening formed in said sliding member for engaging with said second end of said follower and for allowing said sliding member to be moved relative to said housing by said follower, and a first spring biasing member engaged with said sliding member for biasing said sliding member to rotate said follower relative to lock housing, and to rotate said handle and said rotary member relative to said casing and said housing, and for biasing said handle back to an original position and for biasing said actuating finger of said rotary member back to an original position when said handle is released.

2. The lock device as claimed in claim 1, wherein said casing includes a cover attached onto said casing for engaging with said rotary member and for anchoring said rotary member in said compartment of said casing, and includes an orifice formed in said cover for partially receiving said rotary member and for allowing said engaging hole of said rotary member to be exposed and to be engaged with said driving shank.

3. The lock device as claimed in claim 1, wherein said handle includes a second spring biasing member selectively engaged in said handle and attached between said handle and said housing for biasing said handle back to the original position and for biasing said actuating finger of said rotary member back to the original position when said handle is released.

4. The lock device as claimed in claim 3, wherein said housing includes a fastener securing said follower to said housing and to disengage said first end of said follower from said actuating finger when said second spring biasing member is engaged in said handle.

* * * * *